United States Patent [19]

Gerber et al.

[11] Patent Number: 4,562,317

[45] Date of Patent: Dec. 31, 1985

[54] AUTOMOTIVE-TYPE DISTRIBUTOR ROTOR WITH BUILT-IN SUPPRESSOR RESISTOR

[75] Inventors: Richard Gerber, Stuttgart; Dieter Trautwein, Markgröningen, both of Fed. Rep. of Germany

[73] Assignee: Robert Bosch GmbH, Stuttgart, Fed. Rep. of Germany

[21] Appl. No.: 635,530

[22] Filed: Jul. 30, 1984

[30] Foreign Application Priority Data

Sep. 20, 1983 [DE] Fed. Rep. of Germany ..... 3333892

[51] Int. Cl.[4] ..... F02P 7/10; H01C 13/00; H01H 19/00

[52] U.S. Cl. ..... 200/19 DR; 338/66

[58] Field of Search ..... 200/19 R, 19 DC; 338/66; 123/146.5 A, 633

[56] References Cited

U.S. PATENT DOCUMENTS

| | | | |
|---|---|---|---|
| 2,593,205 | 4/1952 | Short et al. | 200/19 DR X |
| 2,688,714 | 9/1954 | Buchmann | 338/66 X |
| 2,790,020 | 4/1957 | Redick et al. | 200/19 DR |
| 3,132,219 | 5/1964 | Kohler | 200/19 DR |
| 4,456,900 | 6/1984 | Toyoshima et al. | 338/66 X |

FOREIGN PATENT DOCUMENTS

| | | | |
|---|---|---|---|
| 1807849 | 12/1969 | Fed. Rep. of Germany | 200/19 DR |
| 3131884 | 7/1983 | Fed. Rep. of Germany . | |
| 3246903 | 10/1983 | Fed. Rep. of Germany . | |
| 874158 | 8/1961 | United Kingdom | 200/19 DR |

*Primary Examiner*—J. R. Scott

*Attorney, Agent, or Firm*—Frishauf, Holtz, Goodman & Woodward

[57] ABSTRACT

To increase the resistance against high-voltage flash-over or arc-over of a distributor rotor with a built-in radio noise suppression resistor (5), the radio noise suppression resistor (5) is formed together with the distribution terminal (1) and a central contact terminal (4) in form of a plate (11) in a unitary subassembly, for example by rivet connection of the terminals to end caps (8, 9) on the resistor, the subassembly then being molded into the rotor body (6) during an injection-molding step. To provide for mechanical strength, the resistor preferably includes fiber-reinforced epoxy as a substrate or carrier, or as a jacket. Preferably, the contact plate (11) is placed at a level below that of the resistor (5) and surrounded by an insulating jacket of increasing thickness towards the plate, so that the thickness of insulating material with respect to adjacent grounded or chassis connection elements, such as an attachment flange or screw bushing (17) is increased.

6 Claims, 4 Drawing Figures

AUTOMOTIVE-TYPE DISTRIBUTOR ROTOR WITH BUILT-IN SUPPRESSOR RESISTOR

BACKGROUND OF THE INVENTION

The present invention relates to a distributor rotor for use in a distributor for a multi-cylinder internal combustion engine, for example of the automotive type, and in which the circuit path between the central terminal of the distributor rotor and the distributor terminal at the circumference thereof includes a suppression resistor.

DESCRIPTION OF THE PRIOR ART

It has previously been proposed to provide a suppressor resistor in the circuit path between the central terminal and the distributor terminal of a distributor rotor—see, for example, German Patent DE-PS No. 31 31 884, Jennrich et al. The noise or interference suppression resistor, the central terminal and the distributor terminal located at the circumference of the distributor rotor are constructed as a subassembly which is placed in an opening of the distributor rotor, typically made of insulating material. The distributor rotor, after assembly, is then completed by casting a potting or casting compound into the opening in which the central terminal—resistor—distribution terminal subassembly has been placed.

It is comparatively time-consuming, and hence expensive, to cast the casting compound around the resistor and the terminals so that no casting compound will overflow the terminals, and thus interfere with proper electrical connection. Substantial care, thus, must be taken in the final manufacturing step.

SUMMARY OF THE INVENTION

It is an object to improve a distributor rotor having a built-in resistor so that it can be easily made, and particularly to facilitate automated or semi-automated manufacture.

Briefly, an elongated resistor structure is placed intermediate a central terminal and a metallic distribution terminal to form a subassembly therewith, the central terminal and the distribution terminal of the distributor being, each, connected to an end portion of the resistor which, preferably, is formed with end caps, so that the subassembly will form a unitary structure. This unitary structure is then embedded by injection molding in the distributor rotor body itself, so that, upon injection-molding of the entire rotor body, the subassembly is embedded therein.

The distributor rotor, and the unitary production process, has the advantage that the contact terminals can readily be maintained free of plastic material, while the separate step of embedding the subassembly including the contact terminals is eliminated.

Surprisingly, it has been found that a distributor rotor so made is particularly resistant to high-voltage arc-over. This is of particularly importance in installations in which the distributor rotor is secured directly to a cam shaft end portion projecting from the internal combustion engine (ICE) with which it is to be used. Distributor rotors of this type are used in ignition systems in which the ignition timing is electronically controlled. Distributor rotors of this type—see, for example, German Patent Disclosure Document DE-OS No. 32 46 903—are subject to high-voltage arc-over faults between the attachment screws, which are part of the distributor rotor assembly and, electrically, connected to ground or chassis, and the contact electrode at the center of the distributor rotor. Such flash-overs or arc-overs result in ignition failure at the spark plugs, and, hence, malfunction of the ICE. The structure in accordance with the present invention reliably avoids such sneak paths or unintended arc-overs. Additionally, the distributor rotor can be made to have different selected shapes, and, particularly, can readily be so constructed that the creep paths are long, to impart additional high-voltage stability to the structure.

DETAILED DESCRIPTION

Figure 1:
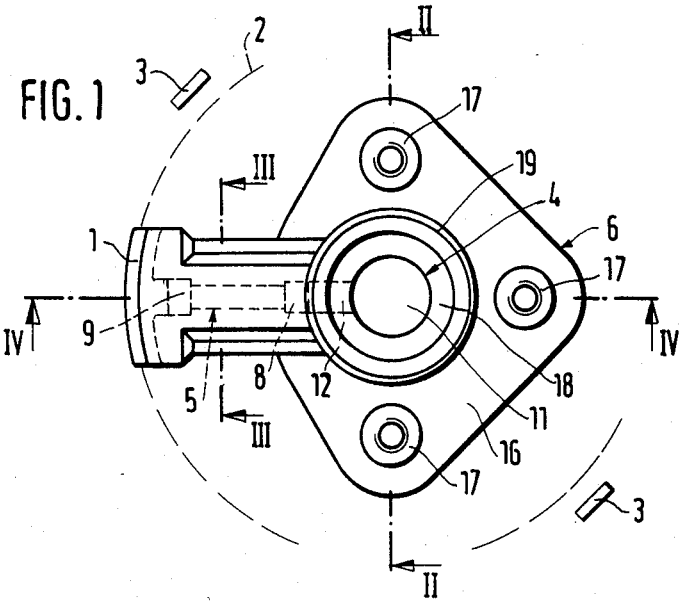
FIG. 1 is a top view of the distributor rotor in accordance with the invention.
Figure 2:
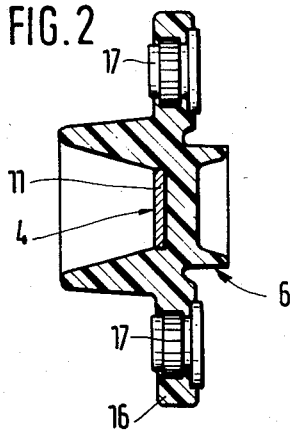
FIG. 2 is a section along line II—II of FIG. 1.
Figure 3:
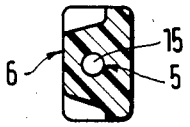
FIG. 3 is a section along line III—III of FIG. 1.

The distributor rotor comprises a rotor body 6 of insulating material, which is shaped for attachment to a rotating part of an ICE, typically of the automotive type, with which it is to be used, to distribute ignition energy to the respective spark plugs thereof. The rotor has a distribution or distributor electrode 1 which, in operation, moves in a circular path 2 to pass by fixed electrdes 3, secured, for example, to the distributor housing. The distributor rotor has a central contact terminal 4 to which high-voltage pulses are supplied by means of a sliding contact, for example a contact ball, which is spring-loaded, a contact spring, or the like, and which receives ignition pulses, for example from an ignition coil under control of breaker contacts, breaker switches, such as transistors, and the like. The ignition system with which the rotor of the present invention is to be used can be of any standard and suitable construction. A high-frequency or radio noise suppression resistor 5 is connected electrically in circuit between the center electrode 4 and the distribution electrode 1. It is, also, structurally placed between the central electrode 4 and the distribution electrode 1. The distribution electrode 1, the suppressor resistor 5, and the central terminal 4 together form a pre-manufactured subassembly which is included in the insulating rotor body 6 of the rotor. The insulating rotor body 6 is formed as an injection-molded element, and made, preferably, of polyester plastic. In manufacture, the subassembly formed of the elements 1, 5, 4 is molded within the injection-molded structure 6, injection molding of the entire distributor body.

the suppressor resistor 5 is a rod or pin-like structure, for example elongated, which has contact caps 8, 9 at its respective ends. The contact caps 8, 9 can be attached to the resistor 5 for example by mechanically applied punch or crease marks 10, or other compressive type of deformation, formed, preferably, circumferentially around the caps 8, 9, and shown in broken lines in FIG. 4.

Figure 4:
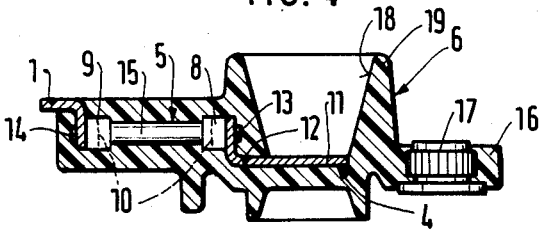
FIG. 4 is a longitudinal section along line IV—IV of FIG. 1.

The central terminal 4 is a circular contact plate 11 which is formed with a radially extending terminal strip 12, the free end of which is bent upwardly and connected by a rivet or other suitable connection to the end of the contact cap 8. FIG. 4 shows the rivet connection 13. The distributor electrode 1 is a metal strip which, likewise, has a bent-over end and which is connected by a rivet 14 to the end face of the contact cap 9.

The suppressor resistor 5, preferably, has an external jacket 15 made of epoxy with a glass fiber reinforcement so that the resistor 5 will not be damaged during the injection molding step upon molding into the body 6.

The body 6 has a laterally extending flange 16 in which metallic bushings 17 are inserted, by being molded into the flange, for example, so that the distributor rotor can be attached to a counter surface which, for example, is located on an end face of a cam shaft of an ICE, not shown.

The rotor is formed with an upstanding cylindrical body 19, formed with an internally inwardly tapering opening 18, which forms a blind hole or blind bore extending towards the contact plate 11 of the central contact 4. Surrounding the central contact 4 with the insulating jacket 19, which, as the hole gets deeper, becomes thicker, increases the quantity of insulating material between the terminal plate 11 of the high-voltage terminal 4 and metallic portions which are at ground voltage—for example the bushings 17 and screws placed therethrough which are provided to attach the rotor to a counter plate at ground or chassis potential. The plate 11 is so located that, looked at from the end of the opening 18, the plate 11 and the adjacent portion of the contact strip 12 are at a lower level than a central axis of the suppressor resistor 5. This arrangement substantially increases the resistance to high-voltage arc-over or flash-over between the central terminal 4 and the attachment bushings 17 or attachment screws passing through the bushings 17, and not shown in the drawings, for simplicity.

We claim:

1. Suppressor-type distributor rotor, for use in a distributor to distribute spark energy to multiple spark plugs of an internal combustion engine, having a rotor body (6) defining a central hub, including a central terminal (4) secured thereto;

a distribution terminal portion having a metallic terminal (1) thereon; and a radially extending connecting portion, connecting the terminal portion to the central hub, including a noise suppression resistor (5) electrically connecting the central terminal (4) and the metallic distribution terminal (1), wherein, in accordance with the invention, said resistor (5) has terminal caps (8, 9) securely attached to its end portions;

the central terminal (4) and the metallic distribution terminal (1) are, each, connected to a respective end of the suppressor resistor (5) and form together a unitary subassembly;

the rotor body (6) is a plastic injection-molded part, said central terminal (4)—resistor (5)—metallic distribution terminal (1) subassembly being integrally molded therein;

and the central terminal (4) comprises a contact plate (11), and a contact strip (12) extending radially therefrom, in essentially the same plane as the plane of the plate (11), and having a bent-up free end which is secured to one end terminal of the resistor (5).

2. Rotor according to claim 1, wherein the resistor (5) has terminal caps (8, 9) securely attached to its end portions;

and wherein the bent-up portion of the contact strip is riveted to an adjacent end cap (8) of the resistor.

3. Rotor according to claim 1, wherein the hub portion comprises an insulating collar (19) formed with a blind central opening (18) therein, the contact plate (11) being located at the bottom of the blind opening, and positioned in a plane which is deeper than a theoretical longitudinal axis through the suppressor resistor (5).

4. Rotor according to claim 2, wherein the hub portion comprises an insulating collar (19) formed with a blind central opening (18) therein, the contact plate (11) being located at the bottom of the blind opening, and positioned in a plane which is deeper than a theoretical longitudinal axis through the suppressor resistor (5).

5. Rotor according to claim 1, wherein the suppressor resistor (5) includes a resistor support structure (15) comprising epoxy resin with glass fiber reinforcement.

6. Rotor according to claim 4, wherein the suppressor resistor (5) includes a resistor support structure comprising epoxy resin with glass fiber reinforcement.

* * * * *